US006856077B2

(12) United States Patent
Oh

(10) Patent No.: US 6,856,077 B2
(45) Date of Patent: Feb. 15, 2005

(54) FLAT PANEL DISPLAY DEVICE

(75) Inventor: Tae-Sik Oh, Suwon (KR)

(73) Assignee: Samsung SDI, Co., LTD, Suwon-si (KR)

( * ) Notice: Subject to any disclaimer, the term of this patent is extended or adjusted under 35 U.S.C. 154(b) by 63 days.

(21) Appl. No.: 10/463,402

(22) Filed: Jun. 18, 2003

(65) Prior Publication Data

US 2004/0113533 A1 Jun. 17, 2004

(30) Foreign Application Priority Data

Dec. 12, 2002 (KR) ..... 10-2002-79229

(51) Int. Cl.[7] ..... H01J 5/16
(52) U.S. Cl. ..... 313/112; 313/110
(58) Field of Search ..... 313/422, 473, 313/110, 112; 359/359

*Primary Examiner*—Vip Patel
(74) *Attorney, Agent, or Firm*—Robert E. Bushnell, Esq.

(57) ABSTRACT

The present invention provides a flat panel display device in which a liquid coating method is used to form various function films that improve contrast and color sense, and prevent external light reflection. The flat panel display device includes a flat display panel for realizing predetermined images and including a front substrate and a rear substrate provided opposing one another with a predetermined gap therebetween, and a filter provided on at least one side of the flat display panel to improve display characteristics. The filter includes a transparent baseplate, and a transmissivity control film that has pigmentation and is formed on at least one side of the baseplate using a liquid coating method. With the use of the liquid coating method to form the filter, productivity is increased, manufacturing costs are minimized, and scratch resistance is provided.

40 Claims, 8 Drawing Sheets

FLAT PANEL DISPLAY DEVICE

CLAIM OF PRIORITY

This application makes reference to, incorporates the same herein, and claims all benefits accruing under 35 U.S.C. §119 from an application entitled "FLAT PANEL DISPLAY DEVICE" filed in the Korean Intellectual Property Office on 12 Dec. 2002 and thereby duly assigned Serial. No. 2002-79229.

BACKGROUND OF THE INVENTION

1. Technical Field

The present invention relates to a flat panel display device, and more particularly, to a flat panel display device in which films having various functions are formed using a liquid coating method, the various functions of the films including improving screen contrast and color sense, and preventing external light reflection.

2. Related Art

A flat panel display device refers to a display device that includes a thin display panel to realize a thin profile. This is in contrast to the cathode ray tube that has a substantial depth. Flat panel display devices can include the field emission display (FED) and the plasma display panel (PDP).

Such flat panel display devices include a black film to improve contrast. In the case where a luminosity factor is high at particular wavelengths, a compensation film that selectively absorbs these wavelengths to improve color sense is provided. Also, the flat panel display device includes an anti-reflection film so that shading of the screen does not occur as a result of external light.

Further, in the case of some plasma display panels, ultraviolet rays that pose a health risk are emitted, as are near infrared rays that cause the inadvertent operation of various electronic devices controlled by remote controllers. Therefore, films that shield the electromagnetic waves, ultraviolet waves, and near infrared rays are needed.

As a result, the flat panel display device provides a filter to an external surface of a front substrate to accomplish the above-described objects of improving contrast and color sense, preventing external light reflection, and blocking electromagnetic waves, ultraviolet waves, and near infrared rays in the case of the plasma display panel. The above-described filter is formed by selecting various films that accomplish these described objects, providing those various films onto a transparent baseplate (e.g., a glass or acryl plate), and then adhering the films to the baseplate. A hot pressing process is typically performed to attach the films.

In the hot pressing process, an adhesive layer is provided between the baseplate and film, and these elements are heated at a high temperature and in a high pressure state to thereby attach the film to the baseplate. As a result, expensive coating films must be used in the hot pressing process. Also, an increase in the number of films results in a corresponding increase in the number of adhesive layers and hot pressing processes that need to be performed.

In addition, in the case where the flat panel display device is made to a large size and requires very strict arrangement conditions, various problems result after the films are attached even with slight variations in the film setting. The film of the extreme outer layer that is attached using the hot pressing process may generate stress from being thermally deformed. If this occurs, a surface of the film is deformed by the stress, and minute cracks are generated on the film surface to thereby reduce the levelness of the screen.

Hence, manufacture of the flat panel display device including a filter made through the hot pressing process as described above results in a reduction in productivity, an increase in production costs, and a low filter quality. Further, surface hardness of the coating films applied to the filter is low such that scratches easily occur. This makes the product less attractive and reduces the lifespan of the device.

SUMMARY OF THE INVENTION

The present invention provides a flat panel display device in which productivity is improved, manufacturing costs are reduced, and scratch resistance is provided while forming films having various functions of improving screen contrast and color sense, and preventing external light reflection.

In one embodiment, the present invention provides a flat panel display device that includes a flat display panel for realizing predetermined images and including a front substrate and a rear substrate provided opposing one another with a predetermined gap therebetween, and a filter provided on at least one side of the flat display panel to improve display characteristics, wherein the filter includes a transparent baseplate, and a transmissivity control film that has pigmentation and is formed on at least one side of the baseplate using a liquid coating method.

A transmissivity of the transmissivity control film is 40~70%, and the transmissivity control film includes pigmentation that absorbs light of a predetermined wavelength to block or enhance a color sense.

The filter further includes an anti-reflection film that is formed on at least one side of the transmissivity control film using a liquid coating method, and a transparent conducting film that is formed on at least one side of the baseplate. The filter further includes, instead of the transparent conducting film, a mesh coating film that is formed on at least one side of the baseplate.

In another aspect, the present invention provides a flat panel display device including a flat display panel for realizing predetermined images and including a front substrate and a rear substrate provided opposing one another with a predetermined gap therebetween; and a filter provided on at least one side of the flat display panel to improve display characteristics, wherein the filter is realized through a baseplate that includes pigmentation.

The baseplate is made of tempered glass that has a transmissivity of 40~70%. The filter further includes an anti-reflection film that is formed on at least one side of the baseplate using a liquid coating method.

The filter further includes a color sense control film that is formed using a liquid coating method on at least one side of the baseplate, the color sense control film absorbing light of a predetermined wavelength.

The filter further includes a transparent conducting film formed using a liquid coating method on at least one side of the color sense control film. The filter further includes, instead of the transparent conducting film, a mesh coating film that is formed on at least one side of the color sense control film.

In yet another aspect, the present invention provides a flat panel display device including a flat display panel for realizing predetermined images and including a front substrate and a rear substrate provided opposing one another with a predetermined gap therebetween; and a filter provided on at least one side of the flat display panel to improve display characteristics, wherein the front substrate includes pigmentation.

A transmissivity of the front substrate is 40~70%, and the filter includes a transparent baseplate and an anti-reflection film that is formed on at least one side of the baseplate using a liquid coating method.

The filter further includes a color sense control film that is formed using a liquid coating method on at least one side of the baseplate, the color sense control film absorbing light of a predetermined wavelength, and a transparent conducting film formed using a liquid coating method on at least one side of the baseplate. The filter further includes, instead of the transparent conducting film, a mesh coating film that is formed on at least one side of the baseplate.

In accordance with the principles of the present invention, as embodied and broadly described, the present invention provides a flat panel display device, comprising: a flat display panel displaying varying visual images, said flat display panel including a front substrate and a rear substrate opposing each other with a predetermined gap therebetween; and a filter being provided on at least one side of said flat display panel, said filter including a transparent baseplate with a transmissivity control film being formed on at least one side of the transparent baseplate by a liquid coating method, the transmissivity control film controlling transmission of light and including pigmentation.

In accordance with the principles of the present invention, as embodied and broadly described, the present invention provides a flat panel display device, comprising: a flat display panel displaying varying visual images, said flat display panel including a front substrate and a rear substrate provided opposing one another with a predetermined gap therebetween; and a filter being provided on at least one of side of said flat display panel, said filter including a baseplate having pigmentation.

In accordance with the principles of the present invention, as embodied and broadly described, the present invention provides a flat panel display device, comprising: a flat display panel displaying varying visual images, said flat display panel including a front substrate and a rear substrate provided opposing one another with a predetermined gap therebetween; and a filter provided on at least one side of the flat display panel, with the front substrate including pigmentation.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DESCRIPTION OF BEST MODE OF CARRYING OUT THE INVENTION

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention. Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Preferred embodiments of the present invention will now be described in detail with reference to the accompanying drawings.

Figure 1:
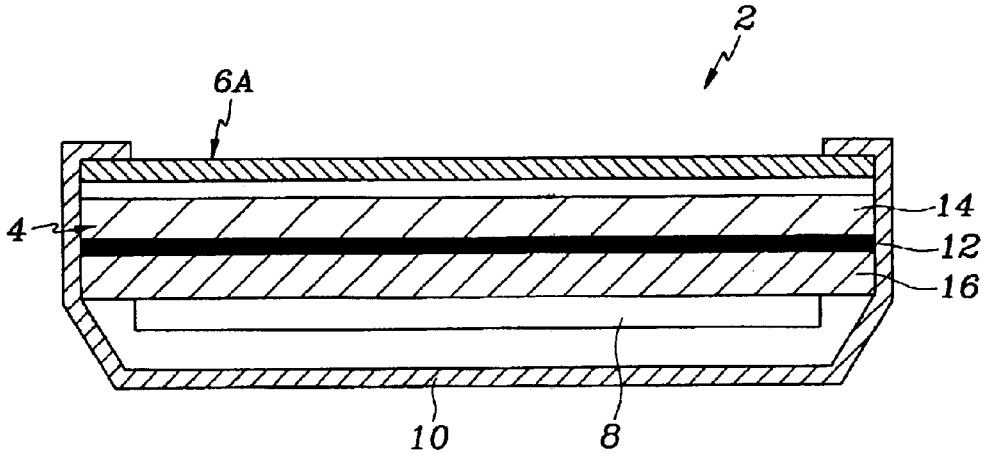
FIG. 1 is a sectional view of a flat panel display device according to a first preferred embodiment of the present invention.

FIG. 1 is a sectional view of a flat panel display device according to a first preferred embodiment of the present invention. A flat panel display device 2 includes a flat display panel 4 that realizes predetermined images, and a filter 6A provided on at least one side of the flat display panel to improve display characteristics. The flat display panel 4 is connected to a drive circuit 8 to receive drive signals, and is provided within a cabinet 10 in such a manner to be fixedly supported therein.

The flat display panel 4 includes a front substrate 14 and a rear substrate 16 that are sealed using a sealant 12 to realize an integrally-formed vacuum assembly. Also, an electron emission unit and an illuminating unit are provided between the front and rear substrates 14 and 16 to display predetermined images on the front substrate 14.

The flat display panel 4 may be a field emission display (FED) or a plasma display panel (PDP). The filter 6A is provided on the side of the flat display panel 4 from which images are displayed, that is the outside of the front substrate 14 in this preferred embodiment, and, as described above, acts to improve display characteristics. This will be described in more detail below.

Figure 2:
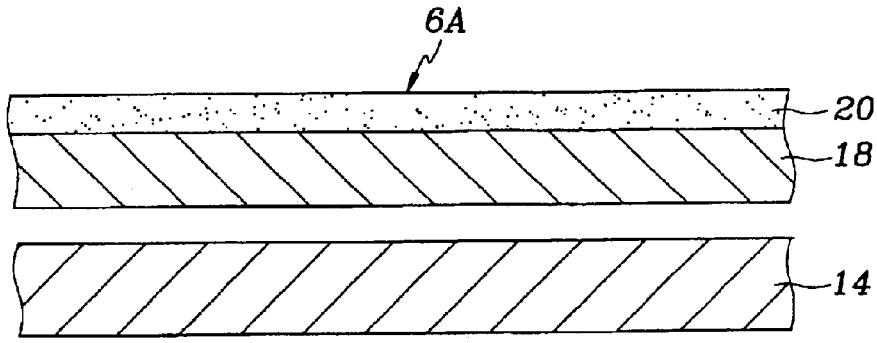
FIG. 2 is an enlarged sectional view of a filter and a front substrate according to the first preferred embodiment of the present invention.

FIG. 2 is an enlarged sectional view of a filter and a front substrate according to the first preferred embodiment of the present invention. FIG. 2 is an enlarged sectional view of the front substrate 14 and the filter 6A of FIG. 1, and will be used to describe a filter structure according to the first preferred embodiment of the present invention.

The front substrate 14 is a transparent glass substrate. The filter 6A includes a transparent baseplate 18, and a transmissivity control film 20 that is colored and formed on at least one side of the baseplate 18 using a liquid coating method. Preferably, the transmissivity control film 20 is formed using a spin coating method on an outer surface of the baseplate 18 such that it is formed on the baseplate 18 having a flat surface and a uniform thickness.

The baseplate 18 is preferably made of tempered glass, in which a surface area is compressed and an inner area is tensed to increase strength. The transmissivity control film 20 contains pigments (i.e., a dye) that selectively absorb light.

In more detail, the transmissivity control film 20 contains a dye(s) that absorbs light uniformly over a visible light range, which has a wavelength of 380~770 nanometers (nm), to realize a transmissivity of 40~70%, and part of the light exiting the front substrate 14 is absorbed to improve screen contrast. The transmissivity of 40~70% means that the transmissivity control film 20 allows 40% to 70% of the light to be transmitted through the transmissivity control film 20. The transmissivity control film 20 does not allow 30% to 60% of the light to be transmitted through the transmissivity control film 20. The transmissivity control film 20 is also known as a transmission control film 20, because the transmissivity control film 20 controls the transmission of light.

Further, the transmissivity control film 20 contains a dye(s) that absorbs light of a specific wavelength(s) to block a specific color sense(s), or to improve a specific color sense. That is, the transmissivity control film 20 contains a dye that absorbs light having a wavelength of 570~590 nanometers (nm) to block a yellow color sense, or dyes that absorbs light having a wavelength of 380~430nm and 570~590nm to simultaneously block a jade green color sense and a yellow color sense.

The filter 6A is formed by providing the transmissivity control film 20 to at least one side of the baseplate 18 using a spin coating method as described above. Therefore, the manufacture of the filter 6A is simple, the filter 6A does not undergo thermal deformation during production, and a good surface hardness of the filter 6A is realized.

Figure 3:
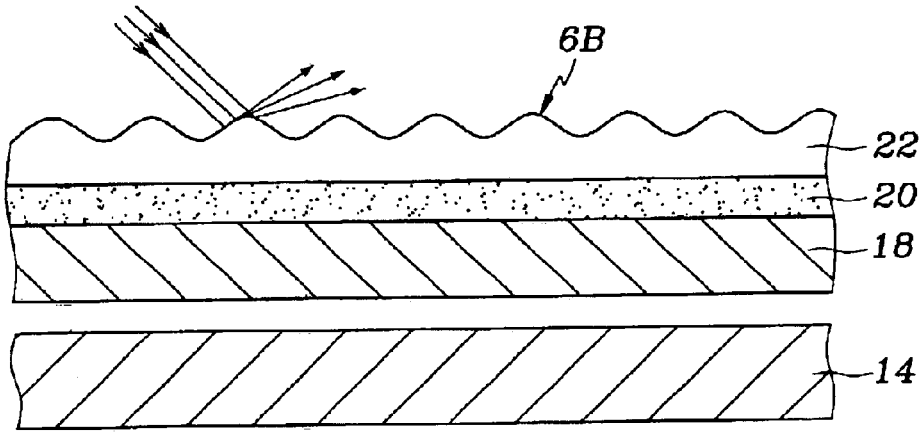
FIG. 3 is an enlarged sectional view of a filter and a front substrate according to a second preferred embodiment of the present invention.

FIG. 3 is an enlarged sectional view of a filter and a front substrate according to a second preferred embodiment of the present invention. As shown in the drawing, a filter 6B according to the second preferred embodiment of the present invention further includes an anti-reflection film 22 formed on an outer surface of a transmissivity control film 20 using a liquid coating method. The anti-reflection film 22 has an uneven surface that includes prominences and depressions. The prominences and depressions can be referred to as hills and valleys, or as bumps and indentations.

Further, the anti-reflection film 22 is made of resin that is transparent and realizes a good degree of hardness following a hardening process. Typical examples of the different types of resin that may be used include acryl resin, epoxy resin, urethane resin, silicon resin, and polyester resin. Preferably, the anti-reflection film 22 is formed having a rough surface (i.e., a surface having prominences and depressions) using a spray coating process. Accordingly, the anti-reflection film 22 diffusely reflects external light such that shading of the screen by external light is prevented and eye fatigue is reduced.

In the case where the flat display panel 4 is a plasma display panel (PDP), a function film for absorbing or blocking electromagnetic waves, ultraviolet waves, and near infrared rays is needed. In the preferred embodiments of the present invention, such a function film is directly formed on a surface of the baseplate 18. Transmissivity control films, mesh coating films, and color sense control films are examples of function films. A transmissivity control film can include an agent which blocks ultraviolet waves and/or near infrared rays, for example. A mesh coating film can block electromagnetic waves. A color sense control film can include an agent which blocks ultraviolet waves and/or near infrared rays, for example.

Figure 4:
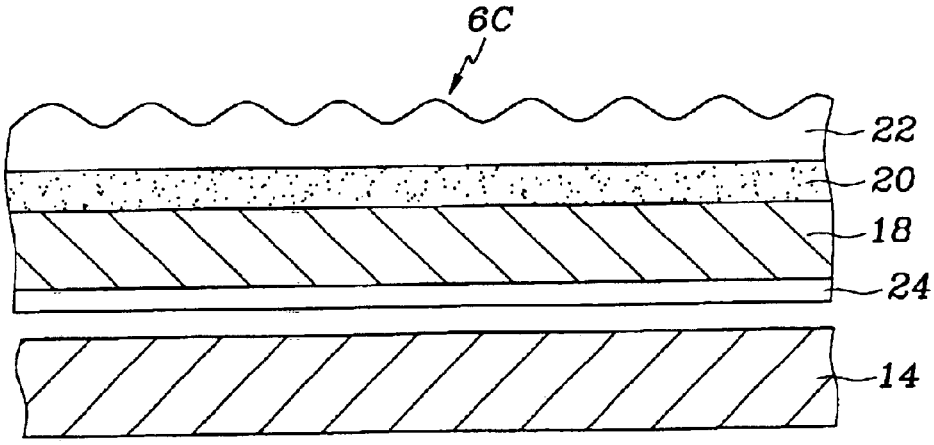
FIG. 4 is an enlarged sectional view of a filter and a front substrate according to a third preferred embodiment of the present invention.

FIG. 4 is an enlarged sectional view of a filter and a front substrate according to a third preferred embodiment of the present invention. In the third preferred embodiment of the present invention, a filter 6C further includes a transparent conducting film 24 that is formed using a liquid coating method on at least one side of a baseplate 18. The transparent conducting film 24 is preferably formed on an inner surface of the baseplate 18 facing a front substrate 14 using a spin coating process to realize a flat outer surface and a uniform thickness. All transparent conducting films in the present invention can also be described as transparent conductive films.

Figure 5:
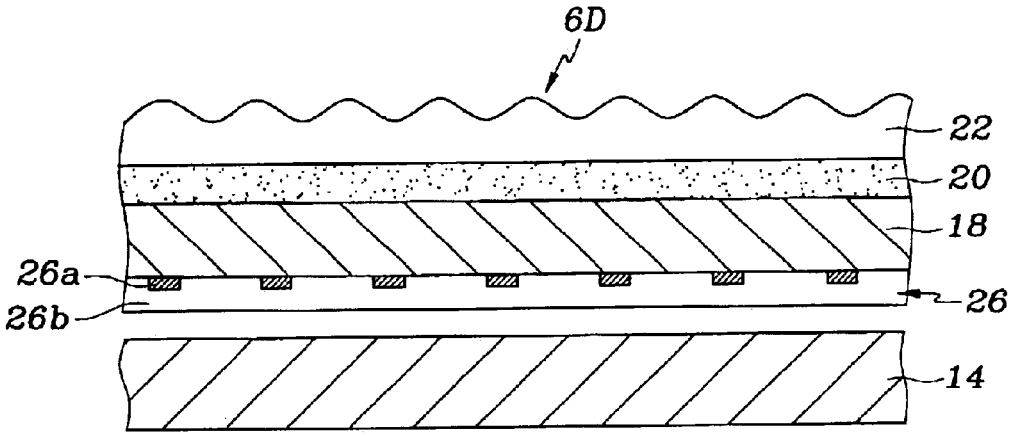
FIG. 5 is an enlarged sectional view of a filter and a front substrate according to a fourth preferred embodiment of the present invention.

FIG. 5 is an enlarged sectional view of a filter and a front substrate according to a fourth preferred embodiment of the present invention. In the fourth preferred embodiment of the present invention, a filter 6D further includes a mesh coating film 26 that is formed on at least one side of a baseplate 18, preferably formed on an inner surface of the baseplate 18 facing a front substrate 14.

The mesh coating film 26 includes a metal mesh 26*a* that is adhered to the baseplate 18, and a transparent resin layer 26*b* that is formed on the baseplate 18 using a liquid coating method and covering the metal mesh 26*a*. Preferably, the transparent resin layer 26*b* is formed using a spin coating method to realize a flat outer surface and uniform thickness.

The transparent conducting film 24 and the mesh coating film 26 block electromagnetic waves generated in a plasma display panel (PDP) drive circuit. Also, a transmissivity control film 20 for both the third and fourth preferred embodiments of the present invention (FIGS. 4 and 5)

preferably includes an ultraviolet wave blocking agent and a near infrared ray blocking agent to block ultraviolet waves and near infrared rays generated in the plasma display panel (PDP).

The transmissivity control film 20, the anti-reflection film 22, the transparent conducting film 24, and the transparent resin layer 26*b* of the mesh coating film 26 are all formed directly on the baseplate 18 using a liquid coating method.

In the flat panel display device 2 of the present invention, rather than using the transmissivity control film 20, it is possible for the baseplate 18 itself to contain pigmentation that selectively absorbs light to thereby control the transmissivity of light.

Figure 6:
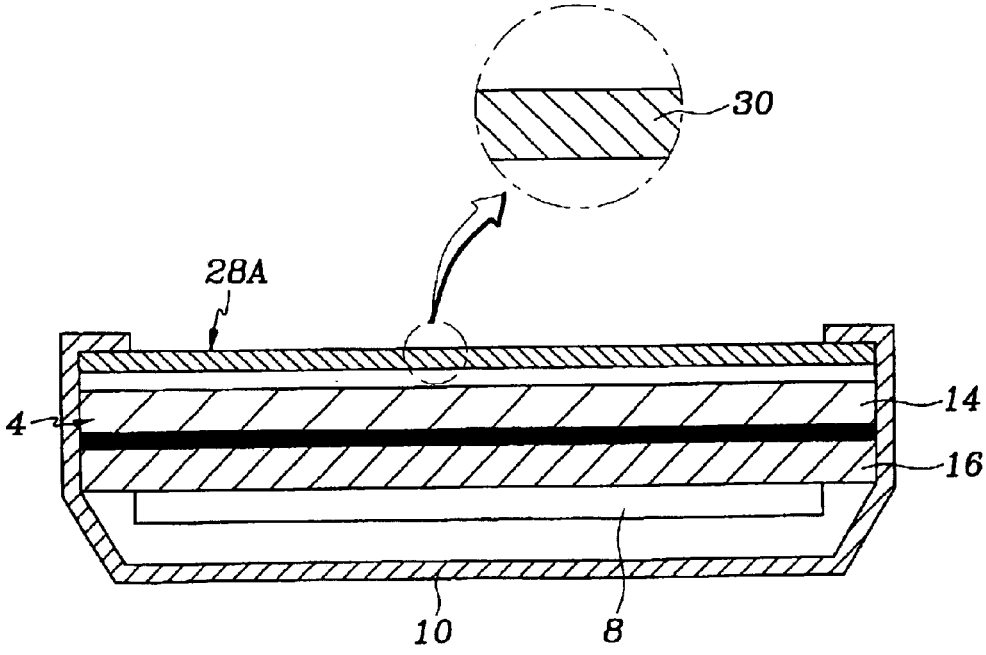
FIG. 6 is a sectional view of a flat panel display device having a filter according to a fifth preferred embodiment of the present invention.

FIG. 6 is a sectional view of a flat panel display device having a filter according to a fifth preferred embodiment of the present invention. In this embodiment, a filter 28A is realized through a baseplate 30 that contains pigmentation. The baseplate 30 is preferably made of tempered glass, and contains a dye(s) that absorbs light uniformly over a visible light range, which has wavelength of 380~770 nanometers (nm), to realize a transmissivity of 40~70%. As a result, part of the visible light exiting a flat display panel 4 is absorbed by the baseplate 30 to thereby improve screen contrast.

Figure 7:
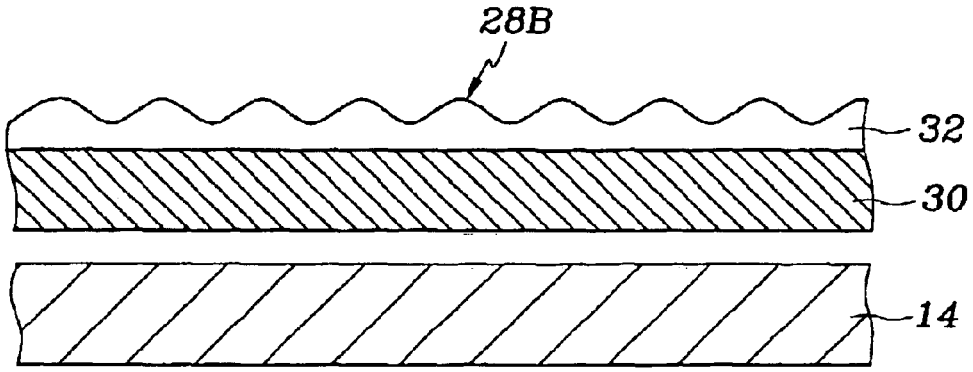
FIG. 7 is an enlarged sectional view of a filter and a front substrate according to a sixth preferred embodiment of the present invention.

FIG. 7 is an enlarged sectional view of a filter and a front substrate according to a sixth preferred embodiment of the present invention. In the sixth preferred embodiment of the present invention, a filter 28B further includes an anti-reflection film 32 that is formed using a liquid coating method on at least one side of a baseplate 30 such that the anti-reflection film 32 has prominences and depressions. Further, the anti-reflection film 32 is preferably formed on an outer surface of the baseplate 30 using a spray coating method to have the prominences and depressions that diffusely reflect external light to thereby reduce eye fatigue.

Figure 8:
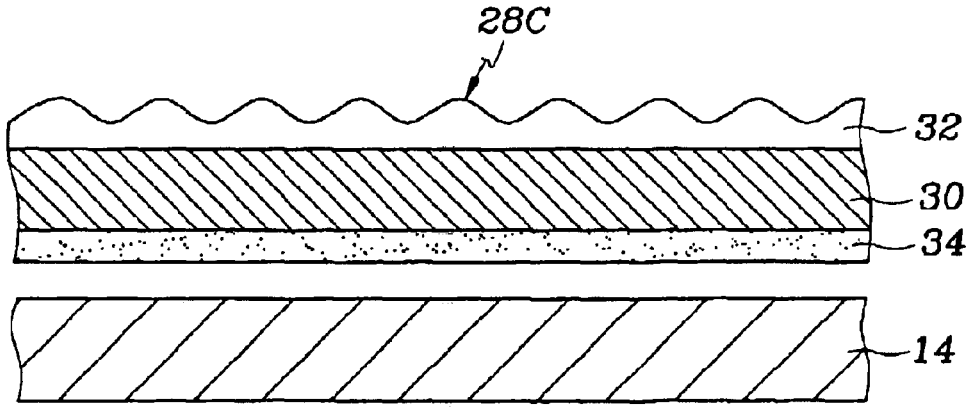
FIG. 8 is an enlarged sectional view of a filter and a front substrate according to a seventh preferred embodiment of the present invention.

FIG. 8 is an enlarged sectional view of a filter and a front substrate according to a seventh preferred embodiment of the present invention. In the seventh preferred embodiment of the present invention, a filter 28C further includes a color sense control film 34 that is formed through a liquid coating method on at least one side of a baseplate 30.

The color sense control film 34 contains pigmentation (i.e., a dye) that absorbs light of a specific wavelength to thereby block a specific color sense or to enhance a specific color sense. The color sense control film 34 is preferably formed on an inner surface of the baseplate 30 facing a front substrate 14 using a spin coating method such that it has a flat outer surface and a uniform thickness.

Figure 9:
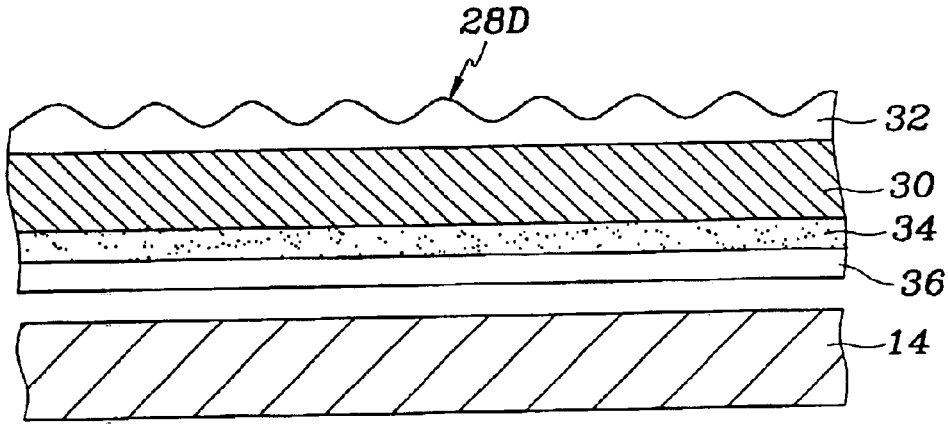
FIG. 9 is an enlarged sectional view of a filter and a front substrate according to a eighth preferred embodiment of the present invention.

FIG. 9 is an enlarged sectional view of a filter and a front substrate according to an eighth preferred embodiment of the present invention. In the eighth preferred embodiment of the present invention, a filter 28D further includes a transparent conductive film 36 formed on at least one side of a color sense control film 34. The transparent conductive film 36 is preferably formed on an outer surface of the color sense control film 34 facing a front substrate 14 using a spin coating method such that it has a flat outer surface and a uniform thickness.

Figure 10:
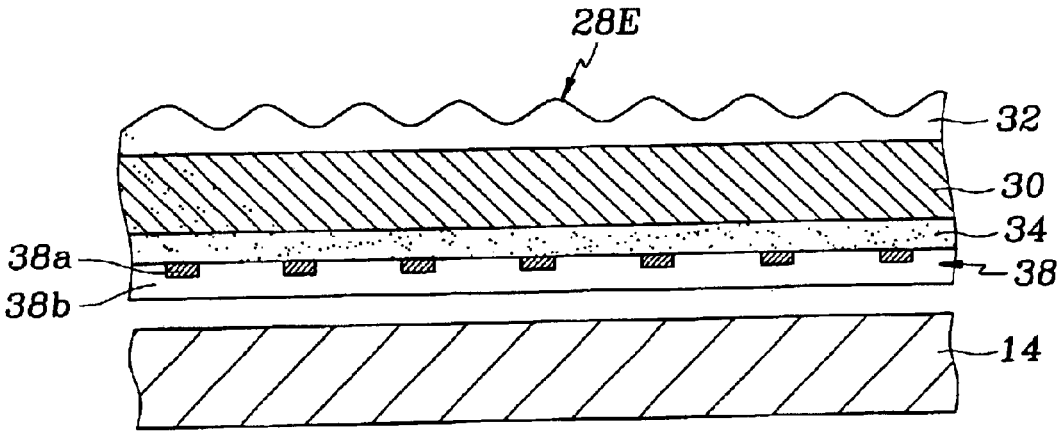
FIG. 10 is an enlarged sectional view of a filter and a front substrate according to a ninth preferred embodiment of the present invention.

FIG. 10 is an enlarged sectional view of a filter and a front substrate according to a ninth preferred embodiment of the present invention. In the ninth preferred embodiment of the present invention, a filter 28E further includes a mesh coating film 38 in place of the transparent conductive film 36 of the eighth preferred embodiment of the present invention.

The mesh coating film 38 includes a metal mesh 38*a* that is adhered to the color sense control film 34, and a transparent resin layer 38*b* that is formed on the color sense control film 34 using a liquid coating method and covering the metal mesh 38*a*. Preferably, the transparent resin layer 38*b* is formed using a spin coating method to realize a flat outer surface and uniform thickness.

The transparent conducting film 36 and the mesh coating film 38 are applied in the case where the flat display panel 4 is a plasma display panel (PDP), and act to block electromagnetic waves generated in the plasma display panel (PDP) drive circuit. Also, the color sense control film 34 for both the eighth and ninth preferred embodiments of the present invention (FIGS. 9 and 10) preferably includes an ultraviolet wave blocking agent and a near infrared ray blocking agent to block ultraviolet waves and near infrared rays generated in the plasma display panel (PDP).

Further, in the preferred embodiments of the present invention, rather than including pigmentation in the baseplate 30 as described above, it is possible to include pigmentation in the front substrate 14 of the flat display panel 4 that selectively absorbs light such that the front substrate 14 itself controls the transmissivity of light.

Figure 11:
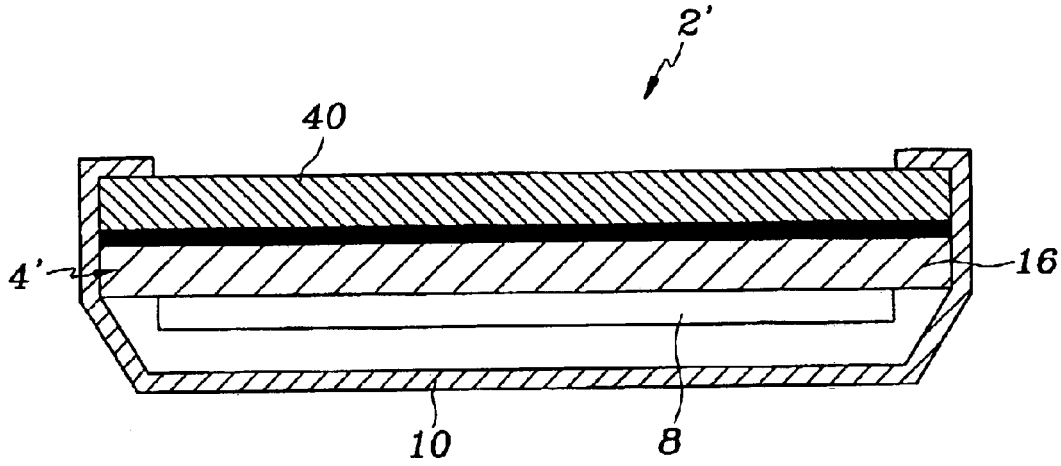
FIG. 11 is a sectional view of a flat panel display device according to another preferred embodiment of the present invention.

FIG. 11 is a sectional view of a flat panel display device according to another preferred embodiment of the present invention. A flat panel display panel 2' includes a front substrate 40 that contains pigmentation.

The front substrate 40 contains a dye(s) that absorbs light uniformly over a visible light range, which has wavelength of 380~770 nanometers (nm), to realize a transmissivity of 40~70%. As a result, part of the visible light exiting a flat panel display panel 4' is absorbed by the front substrate 40 to thereby improve screen contrast.

Figure 12:
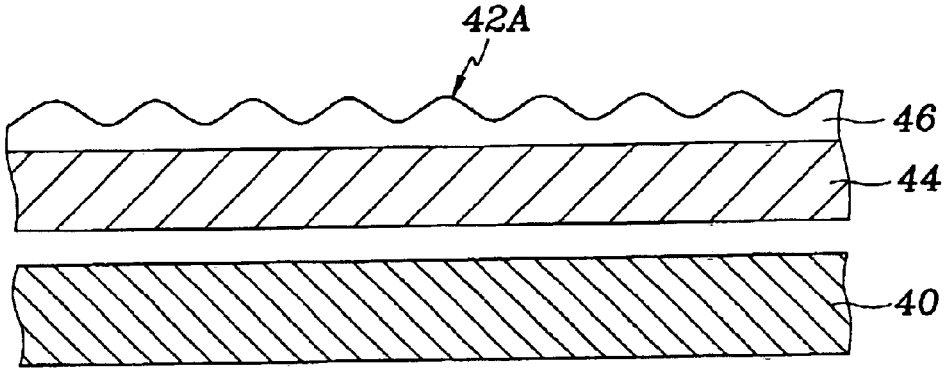
FIG. 12 is an enlarged sectional view of a filter and a front substrate according to a tenth preferred embodiment of the present invention.

The flat panel display device 2' may further include a filter to the outside of the front substrate 40. This will be described below. FIG. 12 is an enlarged sectional view of a filter and a front substrate according to a tenth preferred embodiment of the present invention. In the tenth preferred embodiment of the present invention, a filter 42A includes a transparent baseplate 44 and an anti-reflection film 46 that is formed on at least one side of the baseplate 44 using a liquid coating method such that the anti-reflection film 46 has prominences and depressions.

Preferably, the baseplate 44 is made of tempered glass, and the anti-reflection film 46 is formed on an outer surface of the baseplate 44 using a spray coating method to have the prominences and depressions that diffusely reflect external light to thereby reduce eye fatigue.

Figure 13:
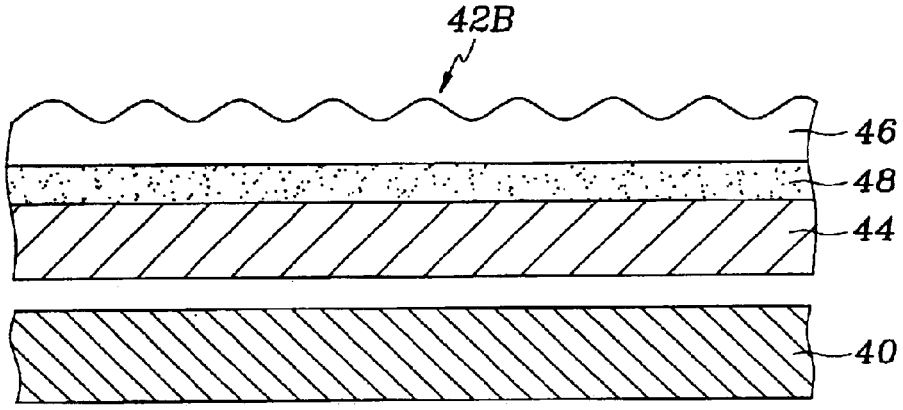
FIG. 13 is an enlarged sectional view of a filter and a front substrate according to a eleventh preferred embodiment of the present invention.

FIG. 13 is an enlarged sectional view of a filter and a front substrate according to an eleventh preferred embodiment of the present invention. In the eleventh preferred embodiment of the present invention, a filter 42B further includes a color sense control film 48 that is formed on at least one side of the a baseplate 44 through a liquid coating method. The color sense control film 48 absorbs light of a specific wavelength. Preferably, the color sense control film 48 is formed between the baseplate 44 and an anti-reflection film 46 using a spin coating method such that it has a flat outer surface and a uniform thickness.

Figure 14:
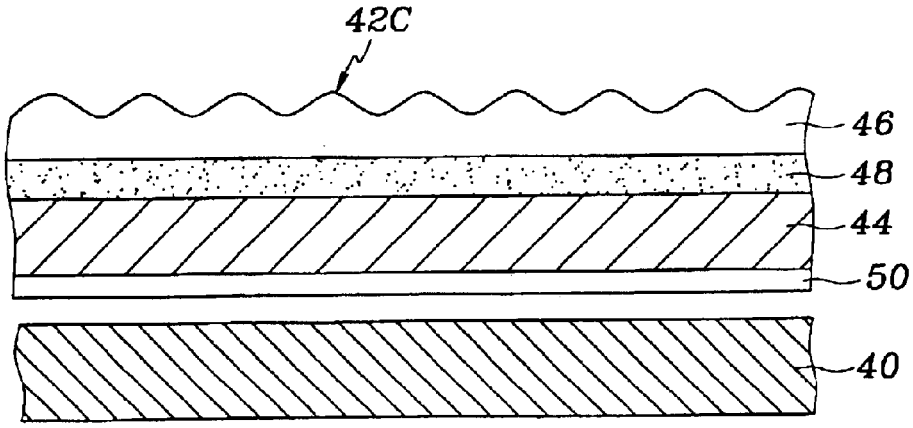
FIG. 14 is an enlarged sectional view of a filter and a front substrate according to a twelfth preferred embodiment of the present invention.

FIG. 14 is an enlarged sectional view of a filter and a front substrate according to a twelfth preferred embodiment of the present invention. In the twelfth preferred embodiment of the present invention, a filter 42C further includes a transparent conductive film 50 formed on at least one side of a baseplate 44 using a liquid coating method. The transparent conductive film 50 is preferably formed on an inner surface of the baseplate 44 facing a front substrate 40 using a spin coating method such that it has a flat outer surface and a uniform thickness.

Figure 15:
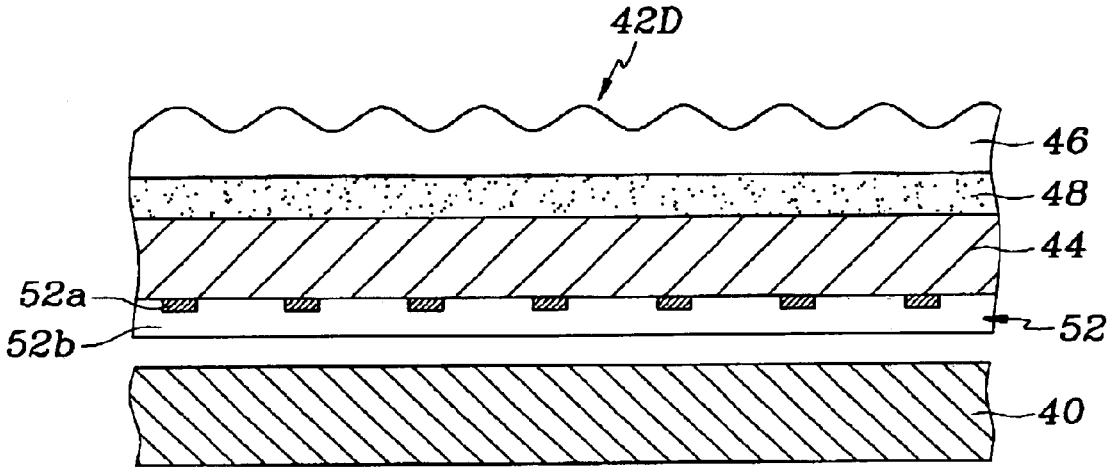
FIG. 15 is an enlarged sectional view of a filter and a front substrate according to a thirteenth preferred embodiment of the present invention.

FIG. 15 is an enlarged sectional view of a filter and a front substrate according to a thirteenth preferred embodiment of the present invention. In the thirteenth preferred embodiment of the present invention, a filter 42D further includes a mesh coating film 52 in place of the transparent conductive film 50 of the twelfth preferred embodiment of the present invention.

The mesh coating film 52 is formed on at least one side of a baseplate 44 and is preferably on an inner surface of the baseplate 44 facing a front substrate 40. The mesh coating film 52 includes a metal mesh 52*a* that is adhered to the baseplate 44, and a transparent resin layer 52*b* that is formed on the baseplate 44 using a liquid coating method and covering the metal mesh 52*a*. Preferably, the transparent resin layer 52*b* is formed using a spin coating method to realize a flat outer surface and uniform thickness.

The transparent conducting film 50 and the mesh coating film 52 are applied in the case where the flat display panel 4' is a plasma display panel (PDP), and act to block electromagnetic waves generated in the plasma display panel (PDP) drive circuit. Also, the color sense control film 48 for both the twelfth and thirteenth preferred embodiments of the present invention (FIGS. 14 and 15) preferably includes an ultraviolet wave blocking agent and a near infrared ray blocking agent to block ultraviolet waves and near infrared rays generated in the plasma display panel (PDP).

In the flat panel display device of the present invention structured and operating as in the above, various function films that improve contrast and color sense, and prevent external light reflection, are formed using a liquid coating method and not a method of adhering the films. Accordingly, manufacturing costs are reduced, and significant hardness is provided to the surfaces of the function films such that they are not easily scratched as with films that are adhered to surfaces of substrates and other films.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit and scope of the applicant's general inventive concept.

What is claimed is:

1. A flat panel display device, comprising:

a flat display panel displaying varying visual images, said flat display panel including a front substrate and a rear substrate opposing each other with a predetermined gap therebetween; and a filter being provided on at least one side of said flat display panel, said filter including a transparent baseplate with a transmissivity control film being formed on at least one side of the transparent baseplate by a liquid coating method, the transmissivity control film controlling transmission of light and including pigmentation.

2. The flat panel display device of claim 1, with the baseplate including tempered glass.

3. The flat panel display device of claim 1, with the transmissivity control film being formed by a spin coating method.

4. The flat panel display of claim 1, with the transmissivity control film having a transmissivity of 40~70%.

5. The flat panel display of claim 1, with the transmissivity control film absorbing light having a wavelength of 570~590 nanometers.

6. The flat panel display of claim 1, with the transmissivity control film absorbing light having a wavelength of 390~430 nanometers and a wavelength of 570~590 nanometers.

7. The flat panel display device of claim 1, with said filter including an anti-reflection film reducing reflection of light, the anti-reflection film being formed on at least one side of the transmissivity control film by a liquid coating method.

8. The flat panel display device of claim 7, with the anti-reflection film being formed by a spray coating method.

9. The flat panel display of claim 1, with said filter including a transparent conductive film on at least one side of the baseplate formed by a liquid coating method, the transparent conductive film at least partly blocking electromagnetic waves.

10. The flat panel display of claim 1, with said filter including a mesh coating film being formed on at least one side of the baseplate, the mesh coating film at least partly blocking electromagnetic waves.

11. The flat panel display of claim 1, with the transmissivity control film including an ultraviolet wave blocking agent at least partly blocking ultraviolet waves.

12. The flat panel display of claim 1, with the transmissivity control film including a near infrared wave blocking agent at least partly blocking near infrared waves.

13. The flat panel display of claim 1, with said flat display panel corresponding to a field emission display.

14. The flat panel display of claim 1, with said flat display panel corresponding to a plasma display panel.

15. A flat panel display device, comprising:

a flat display panel displaying varying visual images, said flat display panel including a front substrate and a rear substrate provided opposing one another with a predetermined gap therebetween; and a filter being provided on at least one of side of said flat display panel, said filter including a baseplate having pigmentation.

16. The flat panel display device of claim 15, with the baseplate including tempered glass.

17. The flat panel display device of claim 15, with the baseplate having a transmissivity of 40~70%.

18. The flat panel display device of claim 15, with said filter including an anti-reflection film reducing reflection of light, the anti-reflection film being formed on at least one side of the baseplate by a liquid coating method.

19. The flat panel display device of claim 18, with the anti-reflection film being formed by a spray coating method.

20. The flat panel display of claim 15, with said filter including a color sense control film being formed by a liquid coating method on at least one side of the baseplate, the color sense control film absorbing light of a predetermined wavelength.

21. The flat panel display of claim 20, with the color sense control film being formed using a spin coating method.

22. The flat panel display of claim 20, with said filter including a transparent conducting film being formed by a liquid coating method on at least one side of the color sense control film, the transparent conducting film at least partly blocking electromagnetic waves.

23. The flat panel display of claim 20, with said filter including a mesh coating film being formed on at least one side of the color sense control film, the mesh coating film at least partly blocking electromagnetic waves.

24. The flat panel display of claim 20, with the color sense control film including an ultraviolet wave blocking agent at least partly blocking ultraviolet waves.

25. The flat panel display of claim 20, with the color sense control film including a near infrared wave blocking agent at least partly blocking near infrared waves.

26. The flat panel display of claim 15, with said flat display panel corresponding to a field emission display.

27. The flat panel display of claim 15, with said flat display panel corresponding to a plasma display panel.

28. A flat panel display device, comprising:

a flat display panel displaying varying visual images, said flat display panel including a front substrate and a rear substrate provided opposing one another with a predetermined gap therebetween; and a filter provided on at least one side of the flat display panel, with the front substrate including pigmentation.

29. The flat panel display device of claim 28, with the front substrate having a transmissivity of 40~70%.

30. The flat panel display of claim 28, with said filter including a transparent baseplate, with an anti-reflection film being formed on at least one side of the baseplate using a liquid coating method, the anti-reflection film reducing reflection of light.

31. The flat panel display device of claim 30, with the baseplate including tempered glass.

32. The flat panel display device of claim 30, with the anti-reflection film being formed by a spray coating method.

33. The flat panel display of claim 30, with said filter including a color sense control film being formed on at least one side of the baseplate by a liquid coating method, the color sense control film absorbing light of a predetermined wavelength.

34. The flat panel display of claim 33, with the color sense control film being formed by a spin coating method.

35. The flat panel display of claim 30, with said filter including a transparent conducting film being formed on at least one side of the baseplate by a liquid coating method.

36. The flat panel display of claim 30, with said filter including a mesh coating film being formed on at least one side of the baseplate, the mesh coating film at least partly blocking electromagnetic waves.

37. The flat panel display of claim 33, with the color sense control film including an ultraviolet wave blocking agent at least partly blocking ultraviolet waves.

38. The flat panel display of claim 33, with the color sense control film including a near infrared wave blocking agent at least partly blocking near infrared waves.

39. The flat panel display of claim 28, with said flat display panel corresponding to a field emission display.

40. The flat panel display of claim 28, with said flat display panel corresponding to a plasma display panel.

* * * * *